US010801775B2

(12) United States Patent
Ragot et al.

(10) Patent No.: US 10,801,775 B2
(45) Date of Patent: Oct. 13, 2020

(54) SYSTEM FOR LIQUEFYING A GAS

(71) Applicant: CRYOSTAR SAS, Hesingue (FR)

(72) Inventors: Mathias Ragot, Sierentz (FR); Frederic Marcuccilli, Colmar (FR)

(73) Assignee: CRYOSTAR SAS, Hesingue (FR)

( * ) Notice: Subject to any disclaimer, the term of this patent is extended or adjusted under 35 U.S.C. 154(b) by 68 days.

(21) Appl. No.: 16/070,880

(22) PCT Filed: Jan. 9, 2017

(86) PCT No.: PCT/EP2017/050351

§ 371 (c)(1),
(2) Date: Jul. 18, 2018

(87) PCT Pub. No.: WO2017/125275

PCT Pub. Date: Jul. 27, 2017

(65) Prior Publication Data

US 2019/0056174 A1 Feb. 21, 2019

(30) Foreign Application Priority Data

Jan. 18, 2016 (EP) ..... 16305044

(51) Int. Cl.
*F25J 1/02* (2006.01)
*F25J 1/00* (2006.01)

(52) U.S. Cl.
CPC ..... *F25J 1/0025* (2013.01); *F25J 1/004* (2013.01); *F25J 1/0037* (2013.01); *F25J 1/0202* (2013.01); *F25J 1/023* (2013.01); *F25J 1/0277* (2013.01); *F25J 1/0279* (2013.01); *F25J 1/0288* (2013.01); *F25J 1/0292* (2013.01); *F25J 1/0294* (2013.01); *F25J 1/0296* (2013.01)

(58) Field of Classification Search
CPC ..... F25J 1/0022; F25J 1/0025; F25J 1/023; F17C 2265/03; F17C 2265/032; F17C 2265/033; F17C 2265/034
See application file for complete search history.

(56) References Cited

U.S. PATENT DOCUMENTS 5,771,693 A 6/1998 Coney
6,062,828 A 5/2000 Townsend
(Continued)

FOREIGN PATENT DOCUMENTS

WO 93/24754 A2 12/1993
WO 2014/209029 A1 12/2014

OTHER PUBLICATIONS

International Search Report dated Mar. 27, 2017 issued in corresponding PCT/EP2017/050351 application (3 pages).

*Primary Examiner* — Brian M King
(74) *Attorney, Agent, or Firm* — Millen White Zelano & Branigan, PC; Brion P. Heaney

(57) ABSTRACT

A system (100) for liquefying a gas comprises a liquid piston gas multistage compressor (2). It can be arranged on-board a liquefied gas carrier for recycling boil-off gas. Such system may be easily adapted or controlled for matching wide requirement ranges for variations of the liquefaction capacity. In addition, at least part of the liquid piston gas multistage compressor can be shared between the gas liquefying system and an extra gas-fed device. Such extra gas-fed device may be in particular a gas-fuelled or hybrid fuel propulsion engine of the vessel.

22 Claims, 3 Drawing Sheets

(56) References Cited

U.S. PATENT DOCUMENTS

| | | | | |
|---|---|---|---|---|
| 6,460,350 | B2 * | 10/2002 | Johnson | F25J 1/0298 62/48.1 |
| 2005/0284155 | A1 | 12/2005 | Bhatt et al. | |
| 2012/0134851 | A1 * | 5/2012 | Adler | F04F 1/06 417/101 |
| 2016/0114876 | A1 * | 4/2016 | Lee | F02C 3/22 60/39.465 |

* cited by examiner

SYSTEM FOR LIQUEFYING A GAS

The invention relates to a system for liquefying a gas. It also relates to a liquefied gas carrier which is equipped with such system.

BACKGROUND OF THE INVENTION

Gas liquefying systems have been known for long time. Such system comprises:

- a gas intake for connection to a gas source;
- at least one gas compressor;
- a gas expansion device, which is connected for being fed with compressed gas produced by the at least one gas compressor, and adapted to produce both liquefied gas and expanded gas from the compressed gas; and
- a return duct which is connected for driving the expanded gas from a gas outlet of the gas expansion device to a duct node situated between the gas intake and the at least one compressor.

Hence such system is provided with a loop-path for the gas, such that part of the gas which has not been converted into liquid upon running only once through the gas expansion device, namely the expanded gas discharged by the gas expansion device, is recycled. Continuous operation of the system thus leads to continuous production of liquefied gas and compensating admission of new gas at the gas intake.

But the gas compressors used so far for such gas liquefying systems belong to the technology of so-called reciprocating compressors. This technology is based on solid pistons which are driven by a rotating motor through a camshaft—or crank—. However such solid piston gas compressors have drawbacks which lead in particular to overhaul requirements which are expensive and cause losses in the operating time of the systems.

Gas liquefying systems in general have numerous applications in many technical fields, including recycling boil-off gas originating from liquefied gas tanks on-board a liquefied gas carrier vessel.

Furthermore, liquid piston gas multistage compressors are well-known. Such liquid piston gas multistage compressor has at least two compressor stages which are connected serially in an ordered chain between the gas intake and an end gas outlet. Each compressor stage comprises at least one cylinder supplied with driving liquid, and also comprises a liquid high-pressure supply device which is arranged for alternately increasing and decreasing a driving liquid quantity contained within the cylinder, so as to load, compress and discharge gas at the compressor stage. Thus, each compressor stage other than the first one in the chain, and called higher compressor stage, is connected to process gas which is outputted by a preceding compressor stage situated in the chain just before said higher compressor stage, through an intermediate gas duct connecting the preceding compressor stage to the higher compressor stage. In this way, gas flowing from the gas intake is pressure-increased each time it is processed by one of the compressor stages, and gas outputted at the end gas outlet has been processed successively by all the compressor stages of the chain. The advantages of such liquid piston gas multistage compressors are explained in the book entitled "Hydraulically Driven Pumps" by Donald H. Newhall, Harwood Engineering Co., Inc., Walpole, Mass., reprinted from Industrial and Engineering Chemistry, vol. 49, No. 12, December 1957, pp. 1949-54. In particular, part of the drawbacks of the reciprocating pumps are alleviated or suppressed.

Starting from this situation, one object of the present invention consists in providing improved gas liquefying systems which do not have the drawbacks of those based on reciprocating pumps.

Another object of the invention consists in providing such a gas liquefying system which can also supply compressed gas to at least one extra gas-fed device, with an easy combination between both functions of liquefying gas and supplying compressed gas to the extra gas-fed device(s).

Still another object of the invention is to provide a design for gas liquefying systems which is up- or down-scalable, for easily matching liquefaction capacities and/or compressed gas supply amounts which are distributed over wide requirement ranges, without substantially modifying the system design.

Still another object of the invention consists in providing such system which is easy and reliable to operate.

SUMMARY OF THE INVENTION

For meeting at least one of these objects or others, a first aspect of the present invention proposes a system for liquefying a gas as described above, but in which the at least one compressor comprises a liquid piston gas multistage compressor. Then, the gas expansion device is connected for receiving compressed gas from the end gas outlet of the liquid piston gas multistage compressor, or from an intermediate gas outlet situated at one intermediate gas duct between two compressor stages which are successive in the chain of the compressor stages.

Because the invention system implements a gas compressor which is based on liquid pistons, varying the number of compressor stages in the chain allows matching wide requirement ranges for liquefaction capacity and possibly also for the compressed gas amounts to be delivered to an extra gas-fed device. In particular, the chain of the liquid piston gas multistage compressor may comprise between two and six compressor stages, including two and six values. Also the compressor stages may share one same source of high-pressure driving liquid, connected in parallel to the liquid high-pressure supply systems of several or all compressor stages. Modifying the compressor stage number can then be performed without significant re-designing work.

Implementing a gas compressor which is based on liquid pistons also allows matching wide requirement ranges for variations of the liquefaction capacity, and possibly also for the compressed gas amounts to be delivered to an extra gas-fed device, by adjusting easily the gas capacities of the compressor stages.

Easy addition of compressor stages to a liquid piston gas multistage compressor used in a gas liquefying system according to the invention allows providing compressed gas to an extra gas-fed device in addition to the gas expansion device, whatever the pressure requirement of the extra gas-fed device.

Drawbacks of the reciprocating pumps are avoided by implementing the liquid piston gas compressor.

Also liquid piston gas multistage compressors can be controlled in a simple and reliable manner, using sensor and control devices which are widely available at reasonable cost.

In some implementations of the invention on-board a liquefied gas carrier, in particular a liquefied gas carrier vessel, the gas intake may be dedicated to be connected so as to receive boil-off gas which originates from liquefied gas contained in a tank or tanks arranged on-board the carrier. This tank thus forms at least part of the gas source. Simultaneously, a liquid outlet of the gas expansion device may be connected to at least one of the liquefied gas tanks for discharging the liquefied gas produced.

Generally, the invention gas liquefying system may be further adapted for delivering compressed gas which has been processed by at least some of the compressor stages of the liquid piston gas multistage compressor, to an extra gas-fed device. For example, gas compressed by some of the compressor stages may be delivered to a fuel gas intake of an engine. When such gas delivery is implemented on-board a liquefied gas carrier, the engine may be a propulsion engine of the carrier or an electrical power generator, as called genset engine. Such propulsion or genset engine may be gas-fuelled or of hybrid fuel engine type.

The gas outlet of the liquid piston gas multistage compressor from which the extra gas-fed device is supplied with compressed gas may be the same one as that which supplies compressed gas to the gas expansion device, or a different one, among the end gas outlet or any one of the intermediate gas outlets along the chain of the compressor stages. The fuel gas intake of the carrier propulsion engine may be fed with compressed gas which originates from the end gas outlet of the liquid piston gas multistage compressor, so that a gas pressure existing at the fuel gas intake of the carrier propulsion engine is in the range of 100 bara to 450 bara (bara for absolute pressure expressed in bars), in particular between 300 bara and 400 bara. In such case, a pre-compressor may be arranged on the gas path between the gas intake and the first compressor stage of the liquid piston gas multistage compressor. Alternatively, the fuel gas intake of the carrier propulsion engine may be fed with compressed gas which originates from an intermediate gas outlet situated at one intermediate gas duct between two compressor stages which are successive in the chain of the liquid piston gas multistage gas compressor. In this latter case, the gas pressure at the fuel gas intake of the carrier propulsion engine may be in the range of 6±1.5 bara or 16±4 bara. Then, the gas expansion device may be fed with compressed gas which originates from the end gas outlet of the liquid piston gas multistage compressor.

A second aspect of the invention proposes a liquefied gas carrier which comprises at least one liquefied gas tank on-board the carrier, and also comprises a system for liquefying a gas in accordance with the first invention aspect. The gas intake of the system is connected for receiving boil-off gas originating from the at least one liquefied gas tank, and the liquid outlet of the gas expansion device is also connected to this at least one liquefied gas tank but for discharging the liquefied gas produced. Such liquefied gas carrier may be a liquefied gas carrier vessel, or a liquefied gas carrier truck, or a liquefied gas rail-carrier, etc.

Possibly, the liquefied gas carrier may further comprise a gas-fuelled carrier propulsion engine or a hybrid fuel carrier propulsion engine. In such case, the chain of compressor stages of the liquid piston gas multistage compressor may be provided with at least one gas outlet for outputting gas processed by at least one of the compressor stages, and this gas outlet is connected to a gas fuel intake of the engine.

Generally, the gas processed by a liquefaction system according to the invention may be any gas, in particular for gas storage or use matters. In particular, it may be methane, ethane, propane, butane and blends thereof, including natural gas and petroleum gas. It may also be methanol, ethanol or dimethyl ether. All these gases may be used as fuel for engines, for example carrier propulsion engines. The liquefied gas carrier may be a liquefied natural gas carrier. Also and possibly in combination, the liquefied gas carrier may be gas-fuelled for propulsion.

However, the gas processed by a liquefaction system according to the invention may also be hydrogen, in particular for storage in view of feeding a fuel cell device with suitable hydrogen flow.

These and other features of the invention will be now described with reference to the appended figures, which relate to preferred but not-limiting embodiments of the invention.

DETAILED DESCRIPTION OF THE INVENTION

Figure 1:
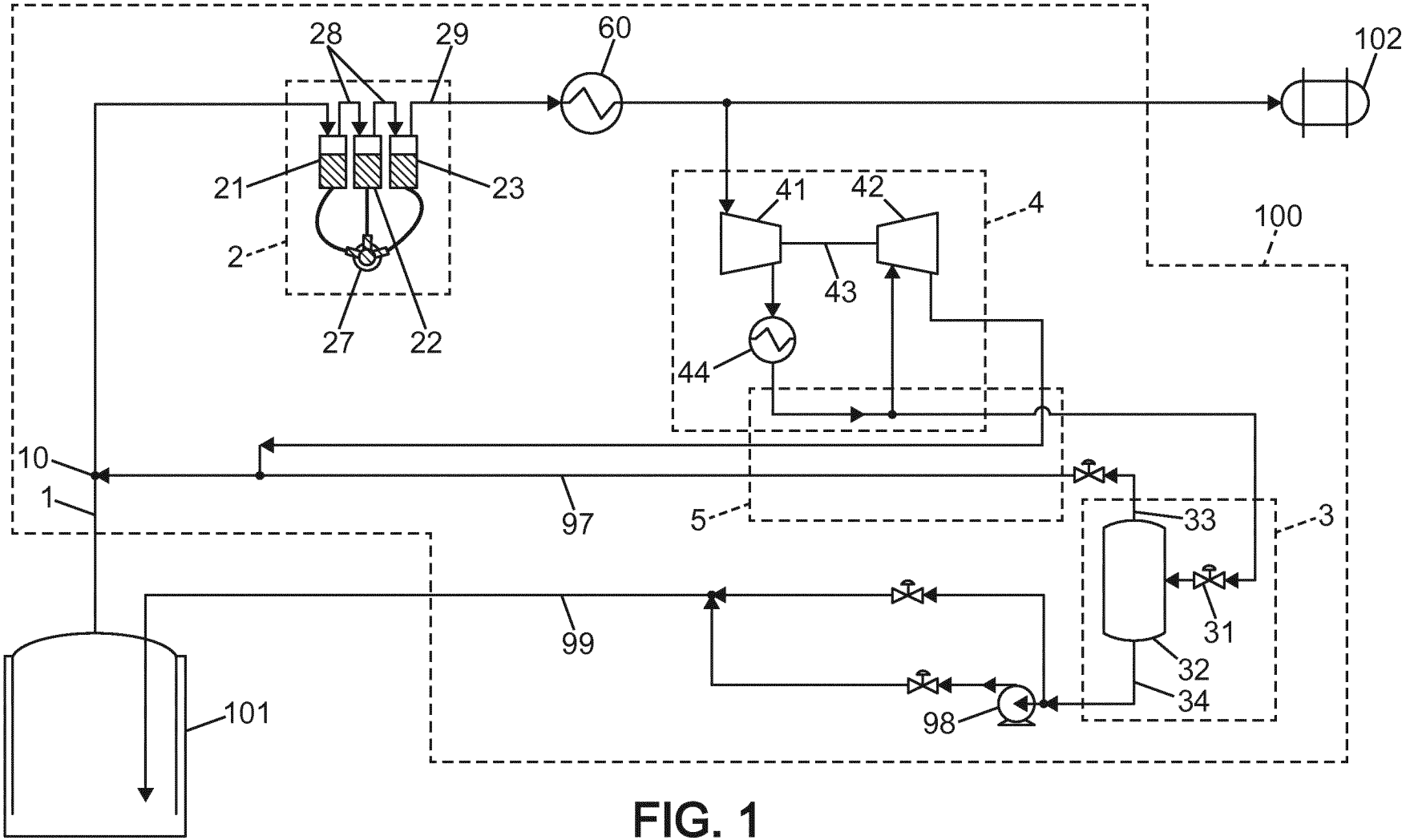
FIGS. 1 to 3 illustrate three possible implementations of the invention. Same reference numbers which are indicated in different ones of these figures denote identical elements of elements with identical function.

The invention is now described in detail for several embodiment examples, but without inducing any limitation with respect to the claim scope. In particular, natural gas processing and application to liquefied natural gas carrier vessels will be described, but other gases and applications are encompassed as well by the claims, with identical implementation features or gas-adapted and/or application-adapted implementation features.

In the figures, the following reference numbers have the meanings now listed:

100 gas liquefying system
101 gas source
102, 102' gas-fuelled or hybrid fuel vessel propulsion engines
1 gas intake of the gas liquefying system
10 duct node
2 liquid piston gas multistage compressor
21-23 or 21-25 three or five compressor stages of the liquid piston gas multistage compressor, numbers three and five being only for illustration purpose
27 source of high-pressure driving liquid
28 intermediate gas ducts of the liquid piston gas multistage compressor
29 end gas outlet of the liquid piston gas multistage compressor
3 gas expansion device
31 expansion valve
32 flash drum
33 gas outlet of the flash drum
34 liquid outlet of the flash drum
4 turbo-compressor
41 centrifugal type booster
42 radial inflow gas expander
43 driving shaft
44 gas cooler
5 heat exchanger
60 gas cooler
80 pre-compressor
97 return gas duct
98 liquefied gas pump
99 return liquid duck The gas source 101 may comprise a tank or several tanks (only one tank is represented in the figures) containing liquefied natural gas, from which originates boil-off gas. Such gas tank(s) may be arranged on-board a liquefied natural gas carrier vessel, for example. In such case, the gas which is processed by a system according to the invention may be the boil-off gas, but it may be also vaporized liquid of natural gas, or a combination of boil-off gas and vaporized liquid of natural gas. This gas processed by the invention system may be comprised of more than 80% in-weight of methane.

The gas intake 10 may be connected for receiving the boil-off gas which originates from the liquefied natural gas, or the vaporized liquid of natural gas.

The gas liquefying system 100 comprises the liquid piston gas multistage compressor 2, the gas expansion device 3, the return gas duct 97, and optionally at least one of the following additional components: the turbo-compressor 4, the multi-stream heat exchanger 5, the gas cooler 60, the pre-compressor 80, the pump for liquefied gas 98, and control valves arranged on the return gas duct 97 and return liquid duck 99.

Figure 2:
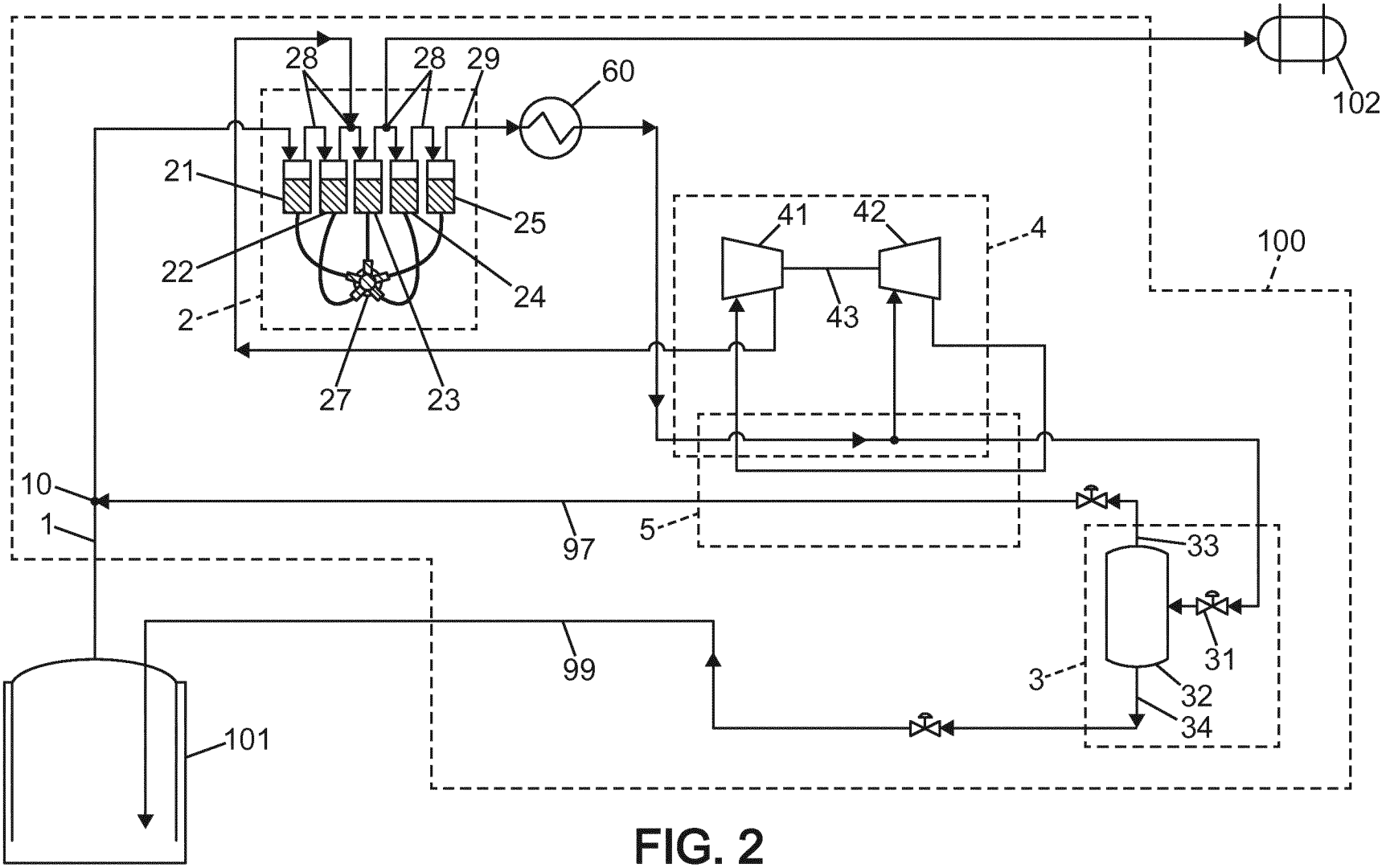
Figure 3:
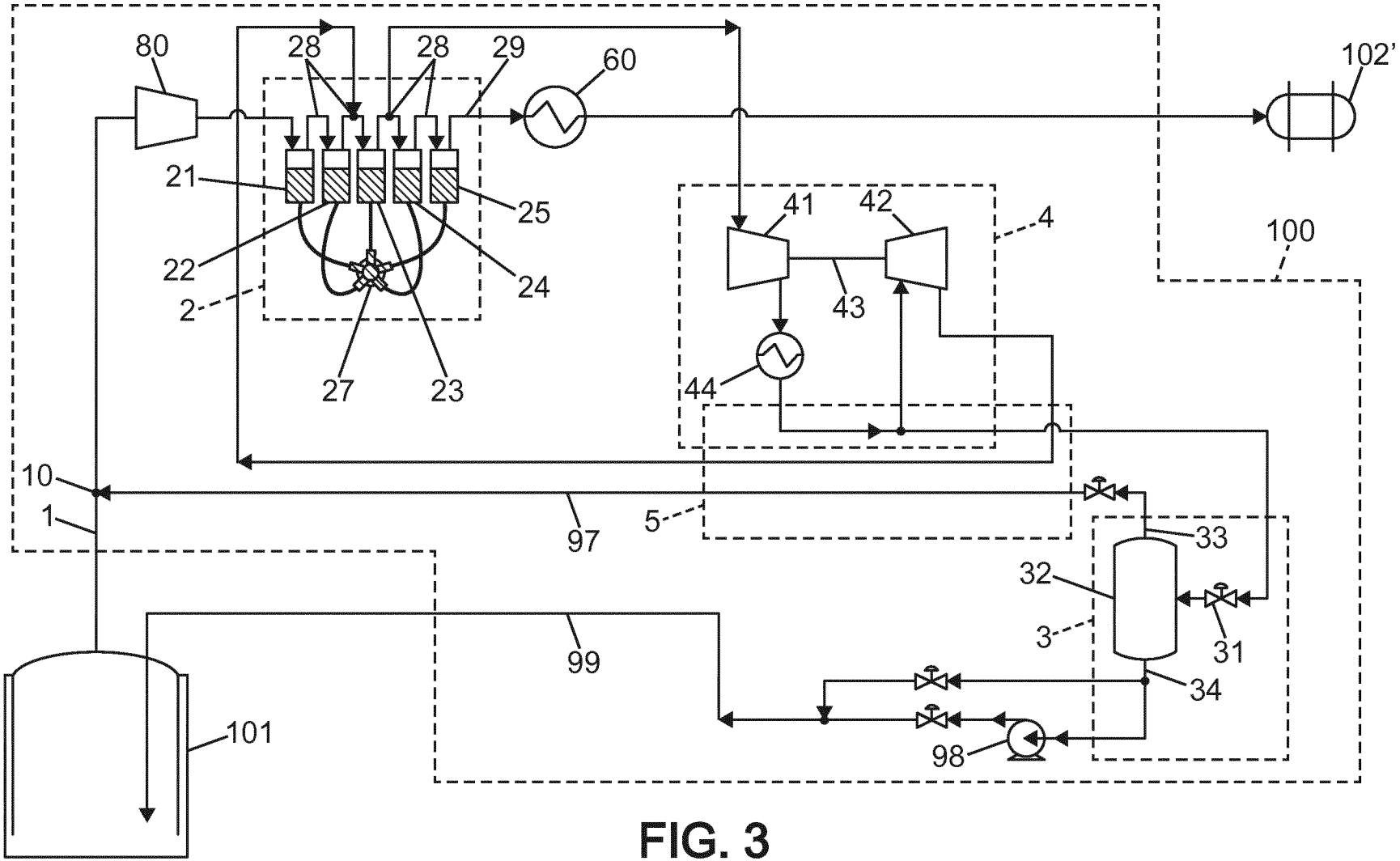

The liquid piston gas multistage compressor 2 comprises several compressor stages 21-23 or 21-25 which are serially connected in a chain, so that each compressor stage processes gas outputted by the compressor stage just before in the chain, except the compressor stage 21 which processes gas originating from the gas intake 10. In the examples represented, compressor stage 21 is the first one in the chain, and compressor stage 23 in FIG. 1, or 25 in FIGS. 2 and 3, is the last one in the chain. Each one of the compressor stages comprises a respective sealed cylinder which is connected for admitting a variable amount of driving liquid, and also comprises a liquid high-pressure supply device which varies the amount of driving liquid contained in the cylinder. The structure of such liquid piston compressor stage is well known, so that it is not necessary to repeat it here. It is only indicated that the repeatedly varied level of the driving liquid within each cylinder, increasingly and decreasingly, produces a flow of compressed gas out from the cylinder of the compressor stage considered. This compressed gas flow depends in particular from the magnitude of the level variation of the driving liquid within the cylinder, and also the frequency of this level variation of the driving liquid within the cylinder. In the frame of this description, the phrase "capacity of one of the compressor stages" indicates the average amount, for example the average weight, of compressed gas which is outputted per time unit by the compressor stage. This capacity results in particular from the magnitude and the frequency of the level variations of the driving liquid within the cylinder. The liquid high-pressure supply device of each one of the compressor stages comprises respective regulation means and a source of high-pressure driving liquid. The source of high-pressure driving liquid may be advantageously shared between the compressor stages, according to reference number 27. The ratio between output gas pressure and intake gas pressure individually for each compressor stage may be between two and fifteen. The regulation means allow easy and real-time adjustment of the capacity of the corresponding compressor stage.

Advantageously within such compressor based on liquid pistons, there is no direct contact between the driving liquid and the gas to compress within each cylinder, for avoiding that the compressed gas is polluted with vapour of the driving liquid or vapours produced by this latter. In particular, document US 2012/0134851 proposes arranging a dummy solid piston between the driving liquid and the gas being compressed. During an operation cycle of the compressor stage, the dummy piston remains on top of the driving liquid within the cylinder, and moves up and down due to the alternating variation in the level of the driving liquid. Dummy pistons within separate cylinders are independent from each other, without solid-based interconnections. A fixed amount of an additional liquid is further provided for producing peripheral sealing between the dummy piston and the inner surface of the cylinder. This amount of additional liquid remains comprised between the peripheral surface of the dummy piston and the inner surface of the cylinder whatever the instant level of the driving liquid by moving together with the dummy piston. This additional liquid is selected for not producing polluting vapours and so that the gas to be compressed does not dissolve into it and does not produce any chemical reaction with it. Liquid of ionic type have been implemented for this purpose, or any other liquid capable of producing the functions of gas-sealing and lubricating. Intercooler devices may be arranged at the intermediate gas ducts 28 between two compressor stages which are successive in the chain of the liquid piston gas multistage gas compressor 2, and between the last compressor stage of the chain and the gas expansion device 3. In this way, the gas flowing within each intermediate gas duct 28 and to the gas expansion device 3 can be cooled down. Thus, the liquid piston gas multistage compressor 2 runs a near-isothermal process which minimizes energy lost to heat generation in comparison with a conventional reciprocating compressor. For clarity sake, the figures only represent such gas cooler device at the gas outlet of the last compressor stage 23 or 25, with reference number 60.

One of the compressor stages 21-23 or 21-25 outputs compressed gas to the gas expansion device 3.

The gas expansion device 3 may comprise and the expansion valve 31 and the flash drum 32. This latter is provided with the gas outlet 33 for discharging the expanded gas, and also with the liquid outlet 34 for discharging the liquefied gas which is produced by the gas expansion device 3. The compressed gas originating from the liquid piston gas multistage compressor 2 and possibly further compressed by centrifugal booster 41 is admitted into the flash drum 32 through the expansion valve 31. The expanded gas is driven to the duct node 10 for being recycled, through the return gas duct 97. Simultaneously, the liquefied gas may be driven back to the gas source 101 if this latter is comprised of at least one tank of liquefied gas, through the return liquid duck 99. Depending on the pressure of the liquefied gas at the liquid outlet 34, the return liquid duck 99 may be provided with the liquefied gas pump 98 or not, and also possibly with a by-pass for temporarily avoiding such pump. The liquefied gas may be thus delivered back to the liquid tank of the gas source 101, with a pressure of about 3.5 bara and a temperature between −140° C. and −150° C.

According to FIG. 1, the turbo-compressor 4 may be arranged between the gas expansion device 3 and the end gas outlet 29 of the liquid piston gas multistage compressor 2, from which said gas expansion device 3 is fed with compressed gas. The turbo-compressor 4 is arranged for compressing the gas delivered to the gas expansion device 3 in addition to compression by the liquid piston gas multistage compressor 2 before delivery of this compressed gas to the gas expansion device 3. In a known manner, the turbo-compressor 4 may comprise the centrifugal type booster 41, the radial inflow gas expander 42, the driving shaft 43 and the gas cooler 44. The booster 41 further compresses the compressed gas originating from the liquid piston gas multistage compressor 2, and part of the resulting compressed gas may be inputted into the expander 42 for driving in rotation the booster 41 through the shaft 43. Then, the expanded gas from the expander 42 may be driven back to node 10 through a dedicated gas duct for recycling. The gas cooler 44 may be arranged at the output of the booster 41 for a first stage in cooling down the resulting compressed gas.

The heat exchanger 5 produces a second stage in the cooling down of the compressed gas which is delivered to the gas expansion device 3. It may be arranged for transferring heat from the compressed gas which is delivered to the gas expansion device 3, to the expanded gas which is produced by this latter. Preferably, the heat exchanger 3 may be of multi-stream type, so as to transfer additionally heat from the expanded gas outputted by the expander 42 to the expanded gas which is produced by the gas expansion device 3. The heat exchanger 5 may be alternatively of several types known in the art.

Generally for the invention, at least some of the compressor stages of the liquid piston gas multistage compressor 2 of the gas liquefying system 100 may also be used for supplying compressed gas to an extra gas-fed device. Such gas-fed device may be any, for example a gas burner, or an electrical power generator, or a gas-fuelled engine, namely an engine to be supplied only with gas as fuel, or a hybrid fuel engine. In this latter case, only the fuel gas supply of the vessel propulsion engine is concerned with the present description. In particular, the engine may be a propulsion engine of a liquefied gas carrier vessel, equipped with the system 100 for re-liquefying boil-off gas.

In the first implementation example represented in FIG. 1, the gas-fuelled engine 102 is gas-fed from the end gas outlet 29 of the liquid piston gas multistage compressor 2, in parallel with the assembly of the turbo-compressor 4, the heat exchanger 5 and the gas expansion device 3. Such structure suits when the gas pressure requirement at the fuel gas intake of the engine 102 is in the range of 16±4 bara. For such embodiment, the compressed gas is preferably cooled down to temperature of about 40° C. to 45° C. by the gas cooler 44.

Similar arrangement may be implemented for supplying gas to an engine which has pressure requirement at the fuel gas intake of this engine, in the range of 6±1.5 bara.

The second implementation example represented in FIG. 2 is suitable again for supplying compressed gas within the pressure range of 16±4 bara to the engine 102, but the input pressure for the gas which is delivered to the assembly of the turbo-compressor 4, the heat exchanger 5 and the gas expansion device 3 is increased, for example to about 40 bara. This allows obtaining a liquefaction yield at the gas expansion device 3 which is higher. To this purpose, the compressor stages 24 and 25 are added in the liquid piston gas multistage compressor 2 with respect to FIG. 1. The engine 102 is gas-supplied again from the gas outlet of the compressor stage 23, but this gas outlet being now an intermediate gas outlet of the chain of the compressor stages, situated at the intermediate gas duct 28 between the compressor stages 23 and 24. Because the pressure at the inlet of the radial inflow gas expander 42 is enough for efficient expansion, the booster 41 is no longer used for the gas fed into the gas expansion device 3, but for additionally compressing the gas issuing from the radial inflow gas expander 42, after this gas has been warmed in the heat exchanger 5, and then re-injecting it at an intermediate gas duct 28 of the chain of the compressor stages of the liquid piston gas multistage compressor 2. In such a system, the booster 41 can be replaced by any expander braking device like an oil pump or a gear driven electrical generator. In the example represented, re-injection is carried out at the intermediate gas duct 28 between the compressor stages 22 and 23. For such implementation, no liquid pump may be required for directing the liquefied gas from the liquid outlet 34 of the flash drum 32 to the gas source 101, because the pressure in the flash drum 32 is high enough for handling the flow of liquefied gas only through a control valve in the return liquid duck 99.

The third implementation example represented in FIG. 3 is suitable for supplying compressed gas within the pressure range of 100 bara to 450 bara to the engine 102'. The liquid piston gas multistage compressor 2 may have five compressor stages again, but the engine 102' is fed with compressed gas from the end gas outlet 29, after compressor stage 25. The gas cooler 60 may be arranged on the path between the end gas outlet 29 and the fuel gas intake of the engine 102'. For reaching the pressure requirement of between 100 bara and 450 bara at the fuel gas intake of the engine 102', the pre-compressor 80 may be arranged on the gas path between the gas intake 1 and the first compressor stage 21 of the liquid piston gas multistage gas compressor 2. The pre-compressor 80 may increase the gas pressure from atmospheric pressure value to between 5 bara and 10 bara. It may be of multistage centrifugal, screw or positive displacement type, in particular. The gas expansion device 3 may then be supplied with compressed gas originating from the intermediate gas duct 28 which is situated between the compressor stages 23 and 24. The turbo-compressor 4 and the heat exchanger 5 may be implemented for the gas which is supplied by the liquid piston gas multistage gas compressor 2 to the gas expansion device 3 in a manner similar to that of the first implementation example of FIG. 1, but without the gas cooler 60 acting on the gas to be liquefied. The expanded gas originating from the radial inflow gas expander 42 may be re-injected in the piston gas multistage gas compressor 2 at the intermediate gas duct 28 which is situated between the compressor stages 22 and 23. For such engines requiring fuel gas intake pressure between 100 bara and 450 bara, the actual fuel gas intake pressure may vary as a function of the engine load. But using a compressor which is based on liquid pistons allows easy control of the fuel gas intake pressure without gas recycling. This can save significant power amount.

Thus, one main advantage of the invention results from the fact that the liquid piston technology allows supplying fuel gas to engines which have very different requirements for the gas pressure at their fuel gas intakes, while sharing the gas compressor with a gas liquefying system. Only the number of compressor stages is to be adapted. As a result, a shipyard can have a practical and standardized design for the combined gas liquefying system and fuel gas supply system, whatever the vessel propulsion engine type.

It must be understood that the invention may be reproduced while adapting some implementation details with respect from the description here-above provided with reference to the figures. In particular, the invention may be implemented whatever the number of compressor stages within the liquid piston gas multistage compressor, and whatever the position of the gas outlet along the chain of the compressor stages which supplies the gas expansion device with compressed gas. Also, the numeral values which have been cited for the gas pressures have only been provided for illustrative purpose.

Also, the invention system may be used for supplying compressed gas to a gas-fed device having limited gas consumption, whereas the gas, for example boil-off gas, may exist initially in excess with respect to the consumption of the gas-fed device. The gas liquefying system of the invention allows recycling the excess of boil-off gas without gas loss and with minimum additional components and minimum energy consumption.

The invention claimed is:

1. A system for liquefying a gas comprising:

a gas intake for connection to a gas source;

at least one gas compressor;

a gas expansion device connected to the at least one gas compressor, and adapted to produce both liquefied gas and expanded gas from the compressed gas; and a return duct connected to a gas outlet of the gas expansion device for delivering expanded gas from the gas expansion device to a duct node situated between the gas intake and the at least one compressor, wherein the at least one gas compressor comprises a liquid piston gas multistage compressor having at least two compressor stages connected serially in an ordered chain between the gas intake and an end gas outlet of the liquid piston gas multistage compressor, each compressor stage comprising at least one cylinder supplied with driving liquid, and a liquid high-pressure supply device arranged for alternately increasing and decreasing a driving liquid quantity contained within the cylinder, so as to load, compress and discharge gas at the compressor stage, each compressor stage further comprising a dummy piston between the driving liquid and the gas being compressed, wherein each compressor stage, other than the first compressor stage in the chain, is in fluid communication with a preceding compressor stage through an intermediate gas duct whereby the compressor stage receives process gas from said preceding compressor stage, so that gas flowing from the gas intake is pressure-increased each time the gas is processed by one of the compressor stages, and gas outputted at the end gas outlet is processed successively by all the compressor stages of the chain, and wherein the gas expansion device is in fluid communication with the end gas outlet of the liquid piston gas multistage compressor to receive compressed gas from the liquid piston gas multistage compressor, or is in fluid communication with an intermediate gas outlet situated at one of said intermediate gas ducts between two successive compressor stages in the chain, said system further comprising:

a booster compressor arranged between the gas expansion device and the end gas outlet of the liquid piston gas multistage compressor or between the gas expansion device and the intermediate gas outlet, wherein the booster compressor further compresses the compressed gas from the liquid piston gas multistage compressor to provide further compressed gas that is to be delivered to the gas expansion device, a branch line for branching off a portion of the further compressed gas prior to delivery of the further compressed gas to the gas expansion device and delivering said portion of the further compressed gas to a gas expander for expanding said portion of the further compressed gas, and a heat exchanger positioned between the booster compressor and the gas expansion device wherein said heat exchanger provides for heat exchange between the further compressed gas that is to be delivered to the gas expansion device and both the expanded portion of the compressed gas from the gas expander and the expanded gas from the gas expansion device.

2. The system according to claim 1, wherein said system is on-board a liquefied gas carrier having tanks containing liquified gas, wherein the gas intake is in fluid communication with said tanks containing liquified gas so as to receive boil-off gas originating from liquefied gas contained in said tanks said tanks forming at least part of the gas source, and wherein a liquid outlet of the gas expansion device is in fluid communication with at least one of the tanks so as to deliver liquefied gas produced by said gas expansion device to said at least one of the tanks.

3. The system according to claim 1, wherein said system is adapted for processing gas containing methane, ethane, propane, butane and blends thereof.

4. The system according to claim 1, further comprising a line adapted for delivering compressed gas processed by at least some of the compressor stages of the liquid piston gas multistage compressor to a fuel gas intake of an engine.

5. The system according to claim 4, wherein said system on-board a liquefied gas carrier having tanks containing liquified gas, wherein the gas intake is in fluid communication with said tanks containing liquified gas so as to receive boil-off gas originating from liquefied gas contained in said tanks, said tanks forming at least part of the gas source, and wherein a liquid outlet of the gas expansion device is in fluid communication with at least one of the tanks so as to deliver liquefied gas produced by said gas expansion device to said at least one of the tanks, and wherein the engine is a propulsion engine of the carrier.

6. The system according to claim 5, wherein the fuel gas intake of the carrier propulsion engine is in fluid communication with the end gas outlet of the liquid piston gas multistage compressor whereby the carrier propulsion engine is fed with compressed gas originating from the end gas outlet of the liquid piston gas multistage compressor, and a gas pressure existing at the fuel gas intake of the carrier propulsion engine is in the range of 100 bara to 450 bara.

7. The system according to claim 6, further comprising a pre-compressor arranged on a gas path between the gas intake and the first compressor stage of the liquid piston gas multistage gas compressor.

8. The system according to claim 5, wherein the fuel gas intake of the carrier propulsion engine is in fluid communication with an intermediate gas outlet situated at one intermediate gas duct between two successive compressor stages of the liquid piston gas multistage gas compressor whereby the carrier propulsion engine is fed with compressed gas a gas pressure existing at the fuel gas intake of the carrier propulsion engine is in the range of 6±1.5 bara or 16±4 bara, and the gas expansion device is in fluid communication with the end gas outlet of the liquid piston gas multistage compressor.

9. The system according to claim 1, wherein the liquid piston gas multistage gas compressor has 2 to 6 compressor stages.

10. The system according to claim 1, further comprising intercooler devices arranged at the intermediate gas ducts between two successive compressor stages of the liquid piston gas multistage gas compressor, and between the last compressor stage of the liquid piston gas multistage gas compressor and the gas expansion device.

11. The system according to claim 1, wherein the gas expansion device comprises an expansion valve and a flash drum, wherein said flash drum is provided with the gas outlet for discharging the expanded gas and with a liquid outlet for discharging the liquefied gas produced by the gas expansion device, and wherein said gas compressor is in fluid communication with the flash drum through the expansion valve.

12. The system according to claim 1, wherein the booster compressor is arranged between the gas expansion device and the end gas outlet of the liquid piston gas multistage compressor.

13. A liquefied gas carrier comprising;

at least one liquefied gas tank on-board said carrier, and a system for liquefying a gas according to claim 1, wherein the gas intake of said system is in fluid communication with the at least one liquefied gas tank to receive boil-off gas therefrom, and a liquid outlet of the gas expansion device is in fluid communication with said at least one liquefied gas tank for discharging the liquefied gas produced by said gas expansion device into said at least one liquefied gas tank.

14. The liquefied gas carrier according to claim 13, further comprising a gas-fuelled carrier propulsion engine or a hybrid fuel carrier propulsion engine, and wherein the compressor stages of the liquid piston gas multistage compressor is provided with at least one gas outlet for removing gas processed by at least one of the compressor stages, and said at least one gas outlet is connected to a gas fuel intake of an engine of said carrier.

15. The system according to claim 1, wherein said system is on-board a liquefied gas carrier vessel having tanks containing liquified gas, wherein the gas intake is in fluid communication with said tanks containing liquified gas so as to receive boil-off gas originating from liquefied gas contained in said tanks, said tanks forming at least part of the gas source, and wherein a liquid outlet of the gas expansion device is in fluid communication with at least one of the tanks so as to deliver liquefied gas produced by said gas expansion device to said at least one of the tanks.

16. The system according to claim 1, wherein said system is adapted for processing gas selected from natural gas and petroleum gas.

17. The system according to claim 1, wherein said system is adapted for processing gas comprising more than 80% in-weight of methane.

18. The system according to claim 1, wherein the booster compressor is arranged between the gas expansion device and the intermediate gas outlet.

19. A system for liquefying a gas comprising:

a gas intake for connection to a gas source;

at least one gas compressor;

a gas expansion device connected to the at least one gas compressor, and adapted to produce both liquefied gas and expanded gas from the compressed gas; and a return duct connected to a gas outlet of the gas expansion device for delivering expanded gas from the gas expansion device to a duct node situated between the gas intake and the at least one compressor, wherein the at least one gas compressor comprises a liquid piston gas multistage compressor having at least two compressor stages connected serially in an ordered chain between the gas intake and an end gas outlet of the liquid piston gas multistage compressor, each compressor stage comprising at least one cylinder supplied with driving liquid, and a liquid high-pressure supply device arranged for alternately increasing and decreasing a driving liquid quantity contained within the cylinder, so as to load, compress and discharge gas at the compressor stage, each compressor stage further comprising a dummy piston between the driving liquid and the gas being compressed, wherein each compressor stage, other than the first compressor stage in the chain, is in fluid communication with a preceding compressor stage through an intermediate gas duct whereby the compressor stage receives process gas from said preceding compressor stage, so that gas flowing from the gas intake is pressure-increased each time the gas is processed by one of the compressor stages, and gas outputted at the end gas outlet is processed successively by all the compressor stages of the chain, and wherein the gas expansion device is in fluid communication with the end gas outlet of the liquid piston gas multistage compressor to receive compressed gas from the liquid piston gas multistage compressor, or is in fluid communication with an intermediate gas outlet situated at one of said intermediate gas ducts between two successive compressor stages in the chain, said system further comprising:

a branch line for branching off a portion of the compressed gas prior to delivery of the compressed gas to the gas expansion device and delivering said portion of the compressed gas to a gas expander for expanding said portion of the compressed gas, and a heat exchanger positioned between the liquid piston gas multistage compressor and the gas expansion device wherein said heat exchanger provides for heat exchange between the compressed gas that is to be delivered to the gas expansion device and both the expanded portion of the compressed gas from the gas expander and the expanded gas from the gas expansion device.

20. The system according to claim 1, further comprising a line for delivering the expanded portion of the compressed gas from said heat exchanger to the return duct for delivering expanded gas from the gas expansion device to the duct node.

21. The system according to claim 1, further comprising a line for delivering the expanded portion of the compressed gas from said heat exchanger to an intermediate gas duct of said liquid piston gas multistage compressor.

22. The system according to claim 19, further comprising a line for delivering the expanded portion of the compressed gas from said heat exchanger to a booster compressor and a further line for delivering compressed gas from said booster compressor to an intermediate gas duct of said liquid piston gas multistage compressor.

* * * * *